US005500634A

United States Patent [19]

Ueda

[11] Patent Number: 5,500,634

[45] Date of Patent: Mar. 19, 1996

[54] VARIABLE RESISTOR

[75] Inventor: Yukinori Ueda, Kyoto, Japan

[73] Assignee: Murata Manufacturing Co., Ltd., Japan

[21] Appl. No.: 187,110

[22] Filed: Jan. 26, 1994

[30] Foreign Application Priority Data

Jan. 29, 1993 [JP] Japan ..... 5-034830

[51] Int. Cl.[6] ..... H01C 10/34

[52] U.S. Cl. ..... 338/174; 338/171; 338/202; 338/162

[58] Field of Search ..... 338/174, 162, 338/202, 171

[56] References Cited

U.S. PATENT DOCUMENTS

| | | | |
|---|---|---|---|
| Re. 34,795 | 11/1994 | Arriazu | 338/174 |
| 4,184,140 | 1/1980 | Frey, Jr. et al. | 334/174 |
| 4,205,296 | 5/1980 | Frey, Jr. | 338/174 X |
| 5,113,172 | 5/1992 | Lang | 338/171 |

FOREIGN PATENT DOCUMENTS

| | | |
|---|---|---|
| 3713075C2 | 10/1987 | Germany . |
| 3841794A1 | 6/1989 | Germany . |
| 63-105303 | 7/1988 | Japan . |
| 3-9286 | 3/1991 | Japan . |

*Primary Examiner*—Marvin M. Lateef
*Attorney, Agent, or Firm*—Ostrolenk, Faber, Gerb & Soffen

[57] ABSTRACT

In order to prevent flux which is employed for soldering an open type pre-set variable resistor from reaching an upper major surface of a substrate provided with a resistor film, a blocking member is formed in a position upwardly separated from a lower major surface of the substrate by a prescribed distance, to block a through hole provided in the substrate. Further, an engaging portion which is provided on a variable side terminal is located in a position downwardly separated from the upper major surface of the substrate by a prescribed distance, to hold a slider which is rotatable about the central axis of the through hole.

12 Claims, 2 Drawing Sheets

VARIABLE RESISTOR

BACKGROUND OF THE INVENTION

1. Field of the Invention

The present invention relates to a variable resistor, and more particularly, it relates to an open type variable resistor.

2. Description of the Background Art

Surface-mountable miniature pre-set variable resistors can be classified into open type ones such as that described in Japanese Utility Model Laying-Open No. 63-105303 (1988), for example, and casing type ones such as that described in Japanese Utility Model Publication No. 3-9286 (1991), for example.

A casing type variable resistor is highly reliable in maintenance of characteristics, since substantially no flux penetrates into its interior in a soldering step and no inconvenience results from such penetration. However, a variable resistor of this type has a relatively large number of components, and hence the cost therefor is increased. Therefore, an open type variable resistor, which is superior in economy to the casing type one, is mainly employed in recent years.

FIG. 4 illustrates an open type variable resistor 1, which is described in the aforementioned Japanese Utility Model Laying-Open No. 63-105303 (1988). This variable resistor 1 comprises a substrate 2 of an electrical insulating material, which is provided with a through hole 3. A horseshoe resistor film 4 is formed on an upper major surface of the substrate 2. A fixed side terminal 5, which is electrically connected to the resistor film 4, is located along one side surface of the substrate 2. A slider terminal 6 is located along a lower major surface and the other side surface of the substrate 2. This slider terminal 6 comprises a cylindrical portion 7, which is positioned in the through hole 3. This cylindrical portion 7 is provided on its upper end with a crimped portion 8, so that a slider 9 is held between the crimped portion 8 and the substrate 2 to be rotatable with respect to the substrate 2. The slider 9 has a contactor 10, which slides along the resistor film 4 upon rotation of the slider 9.

Thus, an electrical path is defined between the fixed side terminal 5 and the slider terminal 6 through the resistor film 4 and the slider 9, and resistance across the terminals 5 and 6 is varied with rotation of the slider 9.

This variable resistor 1 is intended to be lifted by vacuum suction when the same is mounted on a proper circuit board. Therefore, a folded portion 11 is formed integrally with the slider terminal 6, thereby blocking the through hole 3. Thus, the through hole 3 is prevented from causing air leakage during vacuum suction.

However, the aforementioned variable resistor 1 may encounter the following problem: When this variable resistor 1 is soldered onto a proper circuit board by reflow soldering utilizing creamed solder, for example, flux which is contained in the creamed solder may reach the upper major surface of the substrate 2 through surfaces of or clearances between specific elements forming the variable resistor 1, as shown by arrows 12 and 13 in FIG. 4. The flux consequently adheres to the resistor film 4, the slider 9 and the like, to deteriorate the characteristics of the variable resistor 1.

In order to solve the aforementioned problem, it is possible to wash out the flux adhering to undesired portions with an organic solvent. In this case, however, a washing step is additionally required and hence the manufacturing cost for a circuit board mounted with the variable resistor 1 is disadvantageously increased. Further, such washing with an organic solvent is now being restricted in view of environmental protection, and hence it is rather unpreferable to depend on such washing with an organic solvent.

SUMMARY OF THE INVENTION

Accordingly, an object of the present invention is to provide an open type variable resistor, which can solve the aforementioned problem of adhesion of flux to undesired portions.

A variable resistor according to the present invention comprises a substrate, which is made of an electrical insulating material and provided with first and second major surfaces defining a thickness-directional dimension therebetween and a through hole passing through the same along the thickness direction. This substrate holds a fixed side terminal of a conductive material. The substrate is provided on the first major surface with a resistor film, which is electrically connected with the fixed side terminal. The substrate also holds a slider terminal of a conductive material. The slider terminal has an engaging portion which inwardly extends from an inner peripheral surface defining the through hole of the substrate. A slider of a conductive material is held to be rotatable with respect to the substrate about the central axis of the through hole while engaging with the engaging portion. The slider has a contactor which slides on the resistor film by rotation thereof.

In addition to the aforementioned basic structure, the inventive variable resistor further comprises a blocking member for blocking the through hole. This blocking member is arranged in a position which is closer to the second major surface than the engaging portion of the slider terminal and separated from the second major surface toward the first major surface by a prescribed distance.

The inventive variable resistor is soldered onto a circuit board while directing the second major surface of the substrate to the circuit board. At this time, first, flux which is employed in the soldering step hardly reaches the blocking member, since the blocking member is arranged in the position which is separated from the second major surface by a prescribed distance. Second, even if the flux reaches the blocking member, the blocking member inhibits the flux from advancing toward the first major surface. Thus, the flux is inhibited from reaching the engaging portion at this point.

Thus, according to the present invention, the flux is inhibited from finally reaching the resistor film in the two stages, whereby it is possible to obtain a variable resistor which is improved in reliability as to capability of preventing contamination by the flux in a soldering step.

Preferably, the engaging portion is located on a position which is separated from the first major surface toward the second major surface by a prescribed distance. According to such arrangement, even if the flux reaches the engaging portion, this flux is inhibited more surely from reaching the resistor film which is formed on the first major surface.

Preferably, the blocking member is in the form of a plate and extends in a direction intersecting with the inner peripheral surface defining the through hole, so that its peripheral edge portion is located in the substrate.

Preferably, a part of the slider terminal is folded to form the blocking member integrally with the slider terminal. In this case, it is possible to handle the blocking member integrally with the slider terminal, whereby the number of components is not increased by the blocking member.

On the other hand, the substrate is preferably obtained by molding of resin, while the fixed terminal, the slider terminal and the blocking member are inserted in such molding of the substrate. Thus, it is possible to hold the blocking member by the substrate with the fixed side and slider terminals, without depending on specific holding means.

DESCRIPTION OF THE PREFERRED EMBODIMENTS

Figure 1:
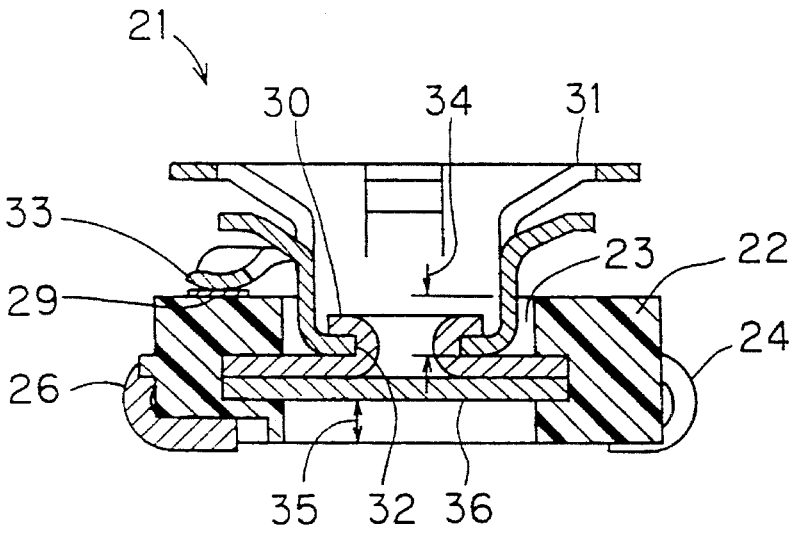
FIG. 1 is a sectional view showing a variable resistor according to an embodiment of the present invention.
Figure 2:
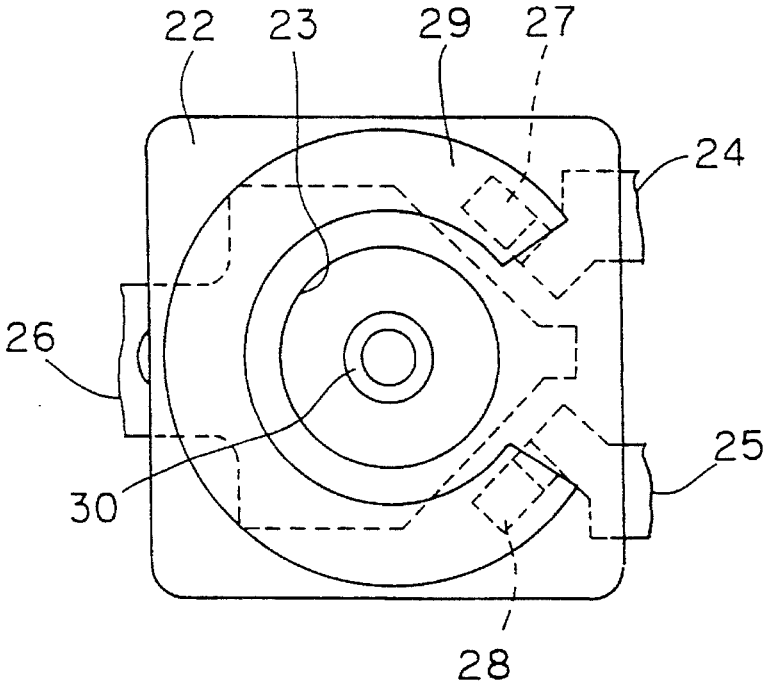
FIG. 2 is a plan view showing an upper major surface of a substrate which is included in the variable resistor shown in FIG. 1.

Referring to FIG. 1, a pre-set variable resistor 21 comprises a substrate 22 of an electrical insulating material. This substrate 22 has a through hole 23 passing through the same along its thickness direction, as shown in FIGS. 1 and 2. The substrate 22 holds two fixed side terminals 24 and 25 and a slider terminal 26, which are made of conductive materials respectively. The substrate 22 is preferably obtained by molding of resin, while the fixed side terminals 24 and 25 and the slider terminal 26 are inserted in such molding of the substrate 22.

The fixed side terminals 24 and 25 comprise portions 27 and 28 which are exposed on an upper major surface of the substrate 22 respectively. As clearly understood from FIG. 2, a resistor film 29 containing carbon, for example, is formed on the upper major surface of the substrate 22. The resistor film 29 is in the form of a horseshoe, and respective end portions thereof cover the exposed portions 27 and 28 of the fixed side terminals 24 and 25 respectively. Thus, the end portions of the resistor film 29 are electrically connected to the fixed side terminals 24 and 25 respectively.

The slider terminal 26 has an engaging portion 30 which inwardly extends from an inner peripheral surface defining the through hole 23 of the substrate 22. A slider 31 of a conductive material is held to be rotatable with respect to the substrate 22 about the central axis of the through hole 23, while engaging with the engaging portion 30. In more concrete terms, the slider 31 has a circular perforation 32, for example, which is located in the through hole 23, and the engaging portion 30 is crimped or bent outward toward a peripheral edge portion defining the perforation 32. Thus, the engaging portion 30 is brought into the shape of an eyelet. FIG. 2 shows a state of the engaging portion 30 which is not yet crimped in the aforementioned manner. The slider 31 comprises a contactor 33, which is elastically in contact with the resistor film 29 and slides along the resistor film 29 by rotation of the slider 31.

Noting the position of the aforementioned engaging portion 30, this engaging portion 30 is preferably located in a position which is separated from the upper major surface of the substrate 22 toward the lower major surface by a prescribed distance 34. On the other hand, a blocking member 36 for blocking the through hole 23 is arranged in a position which is closer to the lower major surface of the substrate 22 than the engaging portion 30 and separated from the lower major surface toward the upper major surface by a prescribed distance 35. The blocking member 36 is preferably in the form of a plate, and extends in a direction intersecting with the inner peripheral surface defining the through hole 23, so that its peripheral edge portion is located in the substrate 22. This blocking member 36 is preferably inserted with the fixed side terminals 24 and 25 and the slider terminal 26 when the substrate 22 is obtained by molding of resin as described above.

According to this embodiment, as hereinabove described, the engaging portion 30 is downwardly separated from the upper major surface of the substrate 22 and the blocking member 36 is provided in the position downwardly separated from the engaging portion 30 and upwardly separated the lower major surface of the substrate 22, whereby flux which is employed in a soldering step is effectively prevented from reaching the upper major surface of the substrate 22. Namely, when the lower major surface of the substrate 22 is directed to a circuit board (not shown) to solder the fixed side terminals 24 and 25 and the slider terminal 26 onto this circuit board, the flux hardly reaches the blocking member 36 due to the distance 35. Even if the flux reaches the blocking member 36, the blocking member 36 inhibits the flux from reaching the engaging portion 30. Even if the flux reaches the engaging portion 30, this flux hardly reaches the upper major surface of the substrate 22 due to the distance 34. Thus, the contactor 33 and the resistor film 29 which is formed on the upper major surface of the substrate 22 are substantially completely prevented from contamination by the flux.

Figure 3:
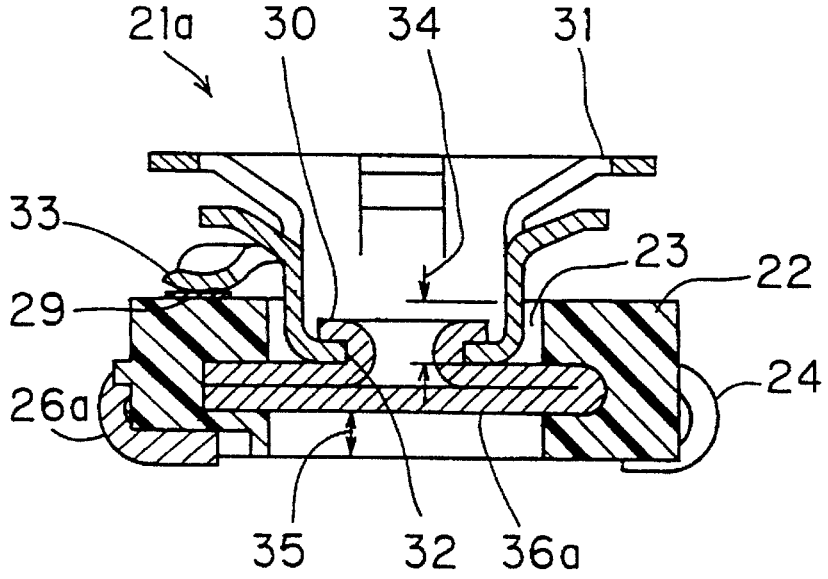
FIG. 3 is a sectional view showing a variable resistor according to another embodiment of the present invention.
Figure 4:
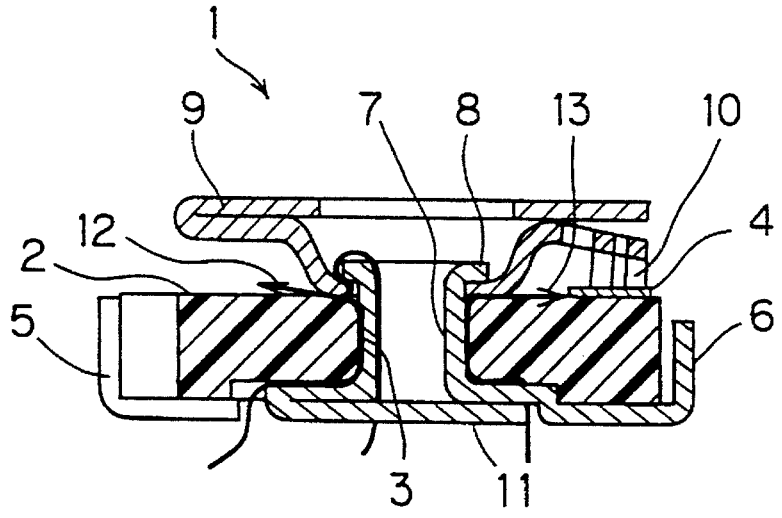
FIG. 4 PRIOR ART
FIG. 4 is a sectional view showing a conventional variable resistor.

FIG. 3 shows a variable resistor **21*a* according to another embodiment of the present invention. Referring to FIG. 3, elements corresponding to those shown in FIG. 1 are denoted by similar reference numerals, to omit redundant description. This variable resistor 21*a* is characterized in that a blocking member 36*a* is integrally formed with a slider terminal 26*a*. In more concrete terms, a part of the slider terminal 26*a* is folded to define the blocking member 36*a*. According to this embodiment, it is possible to handle the blocking member 36*a* integrally with the slider terminal 26*a*, whereby the number of components can be reduced and an assembling operation can be further simplified as compared with the aforementioned embodiment shown in FIG. 1**.

While the present invention has been described in relation to the embodiments shown in the drawings, the present invention is not restricted to these embodiments. Various modifications are available within the scope of the present invention in relation to the structure of engagement between the slider and the slider terminal, the structure of the blocking member which is built in the substrate, the shape of the resistor film and the like, for example.

What is claimed is:

1. A variable resistor comprising: a substrate of an electrically insulating material having first and second major surfaces defining a thickness-directional dimension therebetween and a through hole passing through the same along said thickness direction;

a fixed side terminal of a conductive material mounted on said substrate;

a resistor film being formed on said first major surface of said substrate and electrically connected to said fixed side terminal;

a slider terminal of a conductive material mounted on said substrate and having an engaging portion inwardly extending from an inner peripheral surface defining said through hole;

a slider of a conductive material mounted so as to be rotatable with respect to said substrate about the central axis of said through hole while engaging said engaging portion, said slider having a contactor arranged for sliding along said resistor film by said rotation; and a blocking member for blocking said through hole, structured and arranged in a position closer to said second major surface than said engaging portion and separated from said second major surface, in a direction toward said first major surface, by a first prescribed distance, thereby defining a first gap said first gap coacting with said blocking member to interfere with passage of fluid from said second major surface to said engaging portion.

2. A variable resistor in accordance with claim 1, wherein said engaging portion is located in a position separated from said first major surface, in a direction toward said second major surface, by a second prescribed distance, thereby defining a second gap, said second gap coacting with said first gap and said blocking member to interfere with passage of fluid from said engaging portion to said first major surface.

3. A variable resistor in accordance with claim 1, wherein a peripheral edge portion of said blocking member is located in said substrate.

4. A variable resistor in accordance with claim 3, wherein said blocking member is in the form of a plate, and extends in a direction intersecting with said inner peripheral surface defining said through hole.

5. A variable resistor in accordance with claim 1, wherein said blocking member is formed integrally with said slider terminal.

6. A variable resistor in accordance with claim 5, wherein said blocking member is defined by a folded part of slider side terminal.

7. A variable resistor in accordance with claim 1, wherein said substrate is a molded resin assembly, said fixed side terminal, said slider terminal and said blocking member being molded into said substrate.

8. A variable resistor in accordance with claim 1, wherein said slider has a perforation located in said through hole, said engaging portion being provided by an eyelet portion crimped toward a peripheral edge portion defining said perforation.

9. A variable resistor in accordance with claim 2, wherein said substrate is a molded resin assembly, said fixed side terminal, said slider terminal and said blocking member being molded into said substrate.

10. A variable resistor in accordance with claim 2, wherein a peripheral edge portion of said blocking member is located in said substrate.

11. A variable resistor in accordance with claim 10, wherein said blocking member is in the form of a plate, and extends in a direction intersecting with said inner peripheral surface defining said through hole.

12. A variable resistor in accordance with claim 2, wherein said blocking member is formed integrally with said slider terminal.

* * * * *